US011329396B2

(12) United States Patent
Park et al.

(10) Patent No.: US 11,329,396 B2
(45) Date of Patent: May 10, 2022

(54) ANTENNA PACKAGE HAVING CAVITY STRUCTURE

(71) Applicant: AMOTECH CO., LTD., Incheon (KR)

(72) Inventors: Hyun Joo Park, Seoul (KR); Hyung Il Baek, Yongin-si (KR); Kyung Hyun Ryu, Seoul (KR); Se Ho Lee, Suwon-si (KR); Yun Sik Seo, Suwon-si (KR); Gwang Lyong Go, Suwon-si (KR); Han Ju Do, Pyeongtaek-si (KR)

(73) Assignee: AMOTECH CO., LTD., Incheon (KR)

( * ) Notice: Subject to any disclaimer, the term of this patent is extended or adjusted under 35 U.S.C. 154(b) by 0 days.

(21) Appl. No.: 16/959,103

(22) PCT Filed: Oct. 18, 2018

(86) PCT No.: PCT/KR2018/012334
§ 371 (c)(1),
(2) Date: Jun. 29, 2020

(87) PCT Pub. No.: WO2020/080575
PCT Pub. Date: Apr. 23, 2020

(65) Prior Publication Data
US 2020/0335877 A1 Oct. 22, 2020

(51) Int. Cl.
*H01Q 1/24* (2006.01)
*H01Q 21/06* (2006.01)

(52) U.S. Cl.
CPC ..... *H01Q 21/065* (2013.01); *H01Q 1/241* (2013.01)

(58) Field of Classification Search
CPC ..... H01Q 1/24; H01Q 1/241; H01Q 21/0006; H01Q 21/061; H01Q 21/065; H01Q 21/0087; H01Q 1/2283; H01Q 1/38
See application file for complete search history.

(56) References Cited

U.S. PATENT DOCUMENTS 7,692,590 B2 4/2010 Floyd et al.
8,736,031 B2 * 5/2014 Lee ..... H01L 23/66 257/659

(Continued)

FOREIGN PATENT DOCUMENTS

CN 205029022 U 2/2016
CN 107078405 A 8/2017

(Continued)

OTHER PUBLICATIONS

CN Office Action in Application No. 201880084932.5 dated Dec. 2, 2020.

(Continued)

*Primary Examiner* — Thai Pham
(74) *Attorney, Agent, or Firm* — Maschoff Brennan

(57) ABSTRACT

An antenna package having a cavity structure is provided, wherein a cavity substrate having an accommodation portion formed therethrough is disposed on one surface of an antenna substrate having a signal processing element formed thereon, so as to prevent occurrence of deformation and breakage thereof in the process of mounting the antenna package. The provided antenna package having the cavity structure comprises: an antenna substrate, on the upper surface of which multiple radiation patches are formed and on the lower surface of which multiple signal processing elements are formed; and a cavity substrate which has an accommodation portion formed therethrough to receive the multiple signal processing elements and is disposed on the lower surface of the antenna substrate.

8 Claims, 9 Drawing Sheets

(56) References Cited

U.S. PATENT DOCUMENTS

| | | | | |
|---|---|---|---|---|
| 9,583,817 | B2 | 2/2017 | Watanabe et al. | |
| 2004/0264156 | A1 | 12/2004 | Ajioka et al. | |
| 2005/0088260 | A1* | 4/2005 | Ajioka | H01L 23/66 333/247 |
| 2006/0017157 | A1 | 1/2006 | Yamamoto et al. | |
| 2009/0009399 | A1* | 1/2009 | Gaucher | H01Q 21/0006 343/700 MS |
| 2009/0207080 | A1* | 8/2009 | Floyd | H01L 23/66 343/700 MS |
| 2014/0035097 | A1 | 2/2014 | Lin et al. | |
| 2015/0171523 | A1 | 6/2015 | Kamgaing et al. | |
| 2015/0181739 | A1 | 6/2015 | Fukuda et al. | |
| 2015/0234003 | A1 | 8/2015 | Shiozaki et al. | |
| 2015/0249283 | A1 | 9/2015 | Watanabe et al. | |
| 2017/0222316 | A1 | 8/2017 | Mizunuma et al. | |
| 2020/0145038 | A1* | 5/2020 | Onaka | H01Q 9/045 |

FOREIGN PATENT DOCUMENTS

| | | | |
|---|---|---|---|
| JP | 2005-86603 | A | 3/2005 |
| JP | 2011-512771 | A | 4/2011 |
| JP | 2015-008410 | A | 1/2015 |
| JP | 2015-023360 | A | 2/2015 |
| KR | 10-2009-0021662 | A | 3/2009 |
| KR | 10-2019-0043026 | A | 4/2019 |

OTHER PUBLICATIONS

European Search Report issued in corresponding application No. 18937300.4, dated Jul. 12, 2021.

Japanese Office Action issued in corresponding application No. 2020-536753, dated Jun. 29, 2021.

* cited by examiner

[FIG. 1]
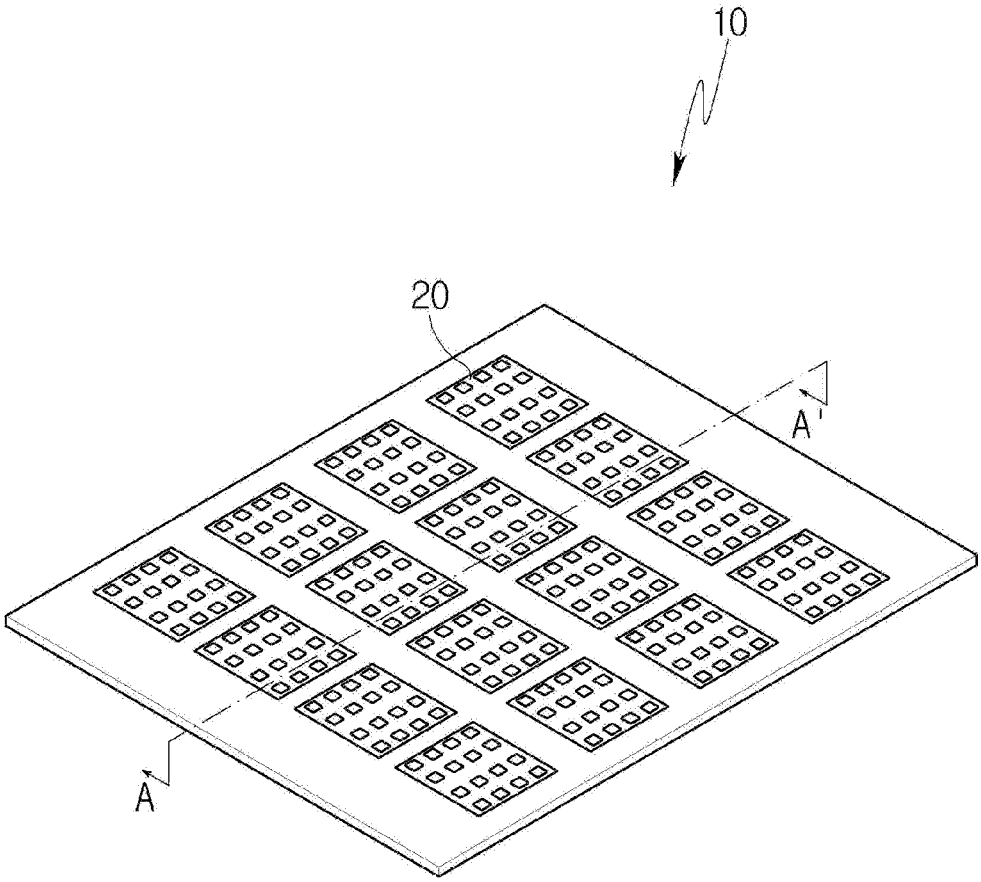

[FIG. 2]
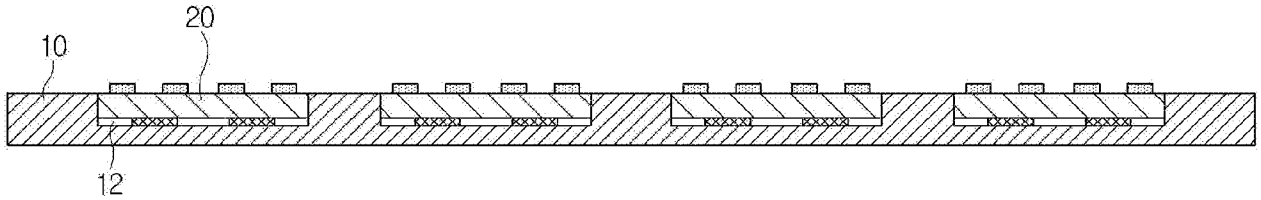

[FIG. 3]
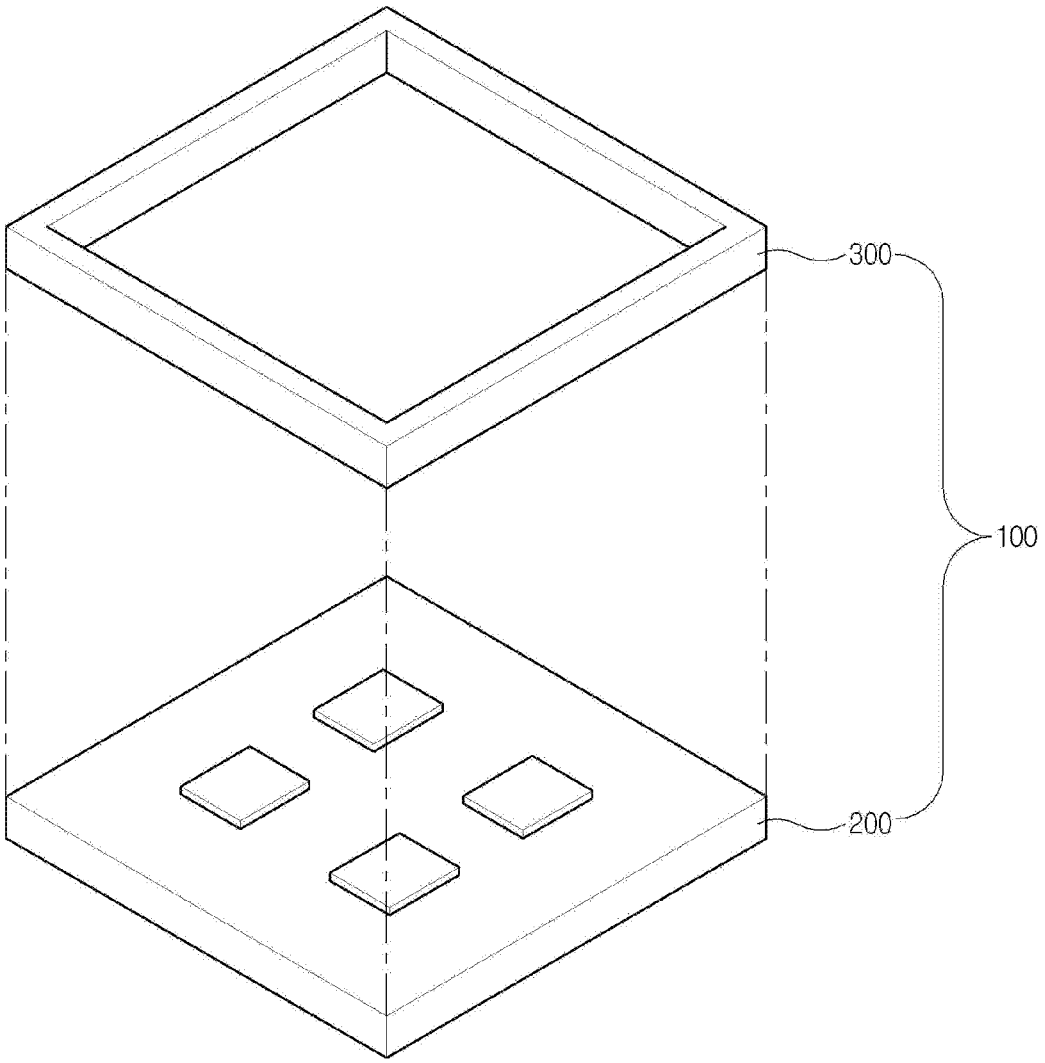

[FIG. 4]
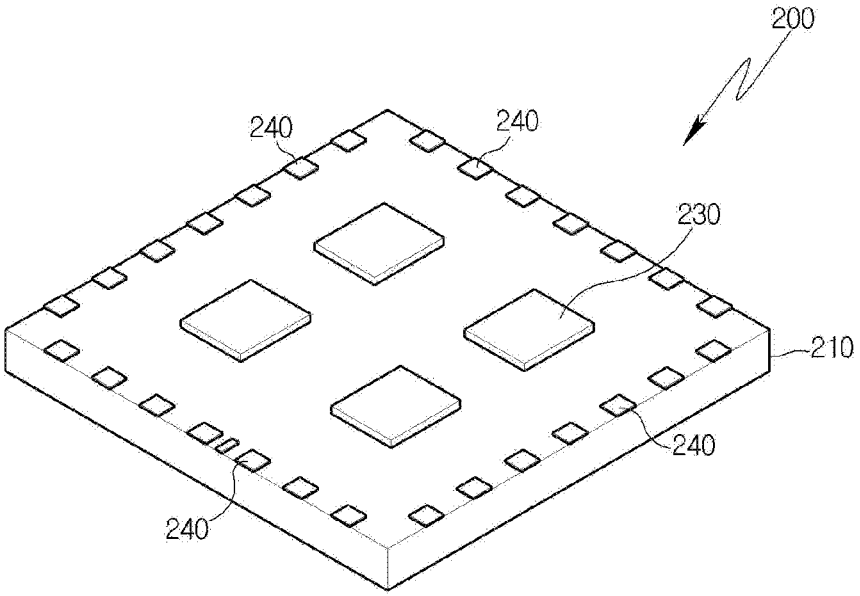
[FIG. 5]
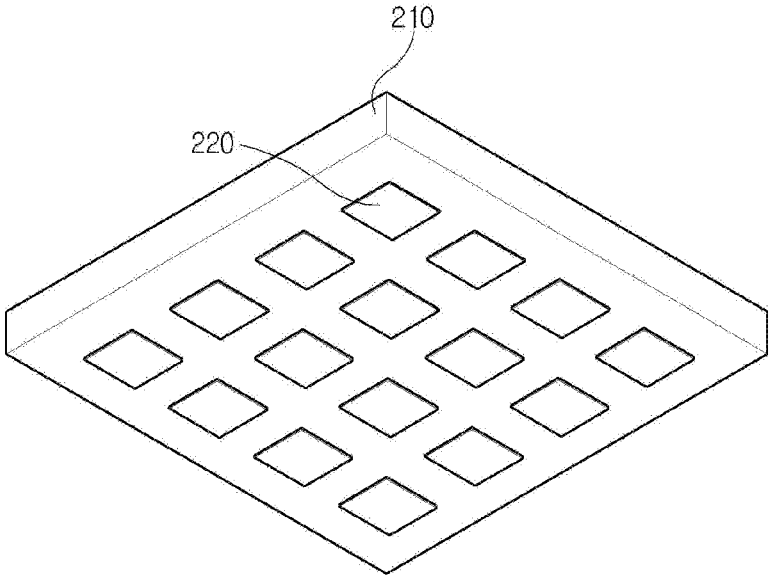
v

[FIG. 6]
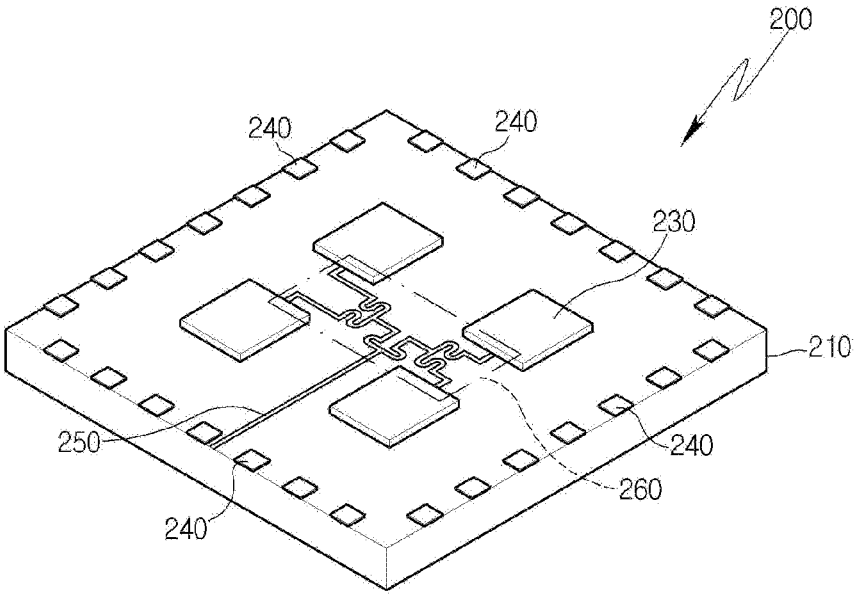
[FIG. 7]
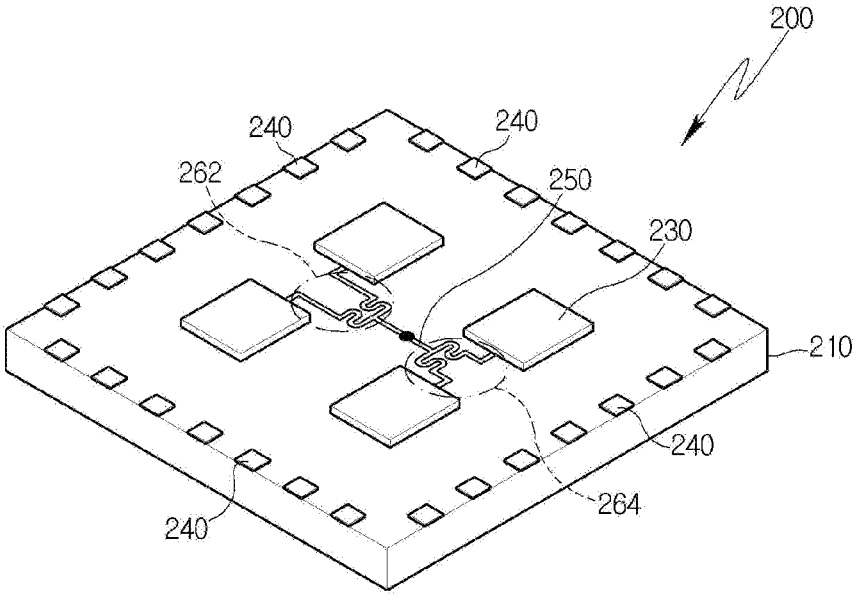

[FIG. 8]
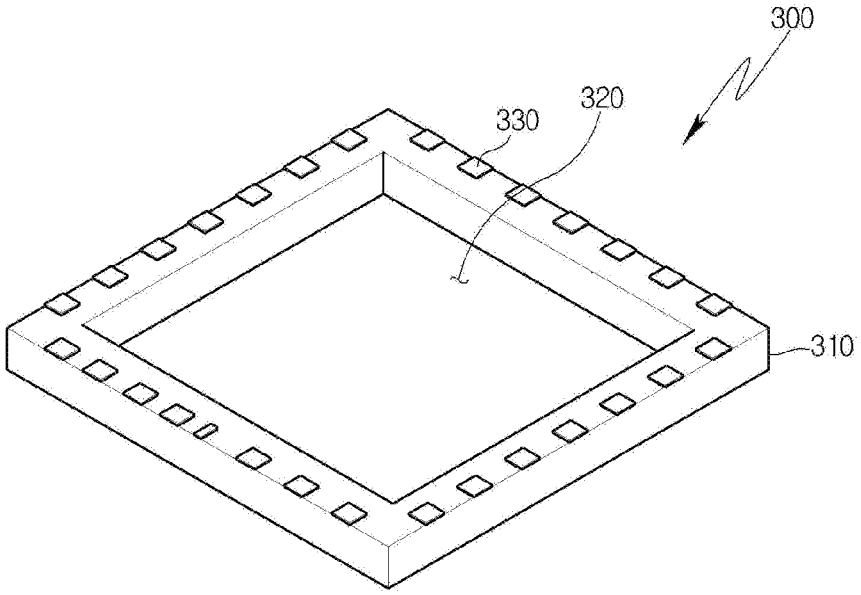
[FIG. 9]
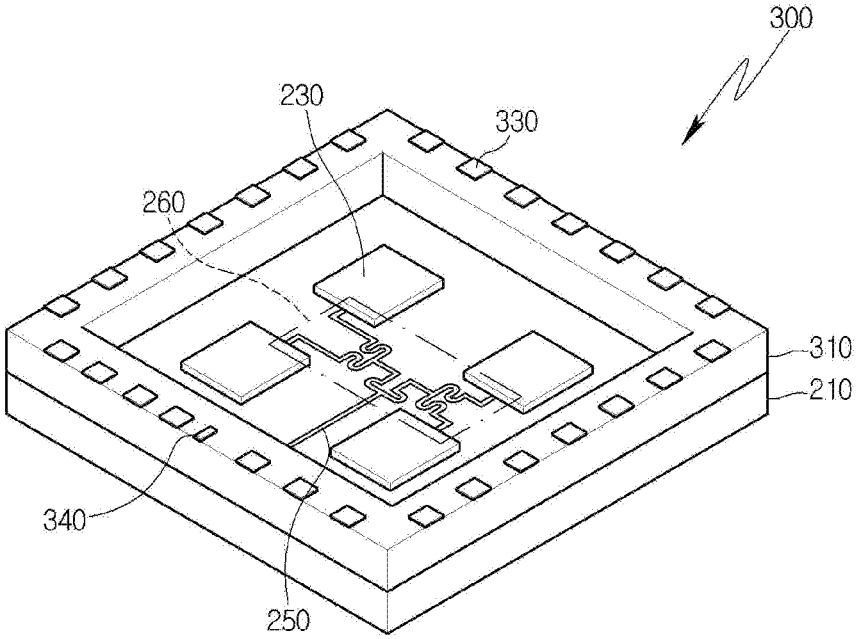

[FIG. 10]
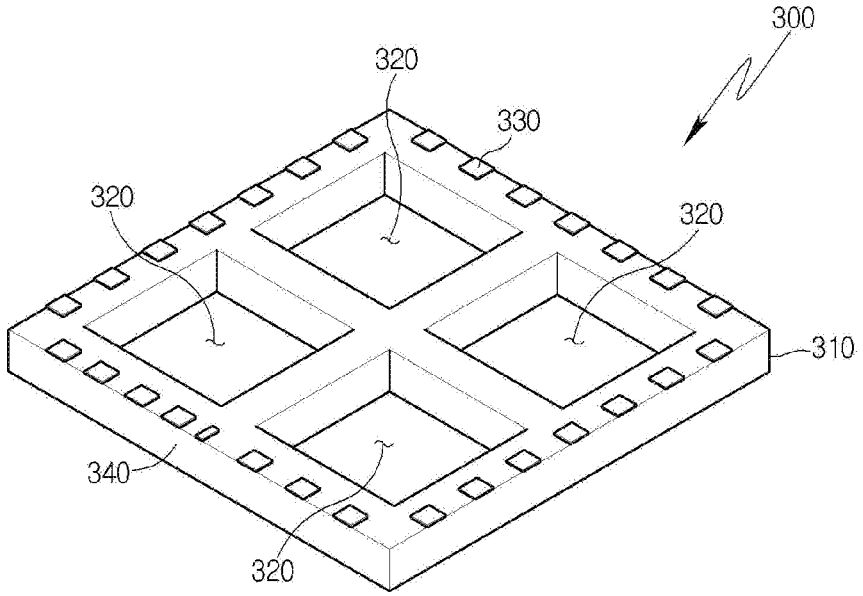
[FIG. 11]
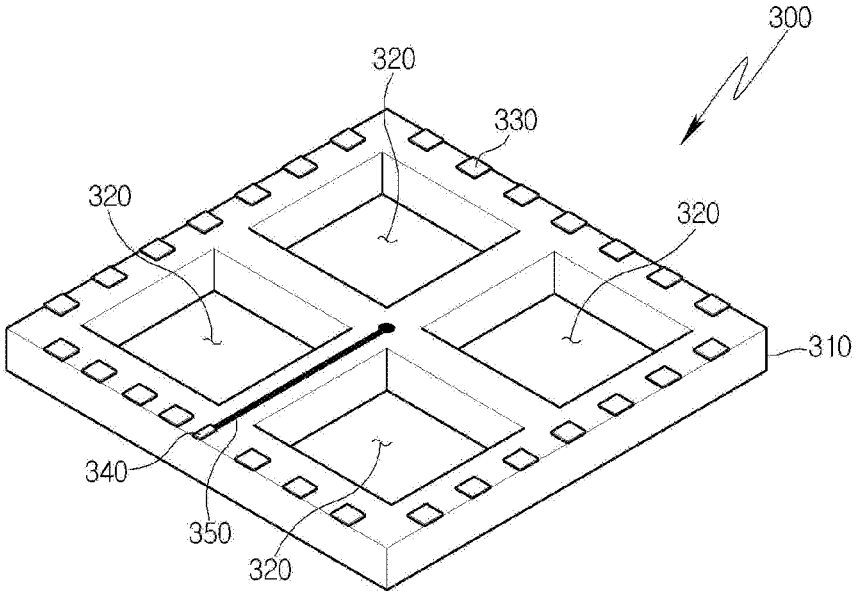

[FIG. 12]
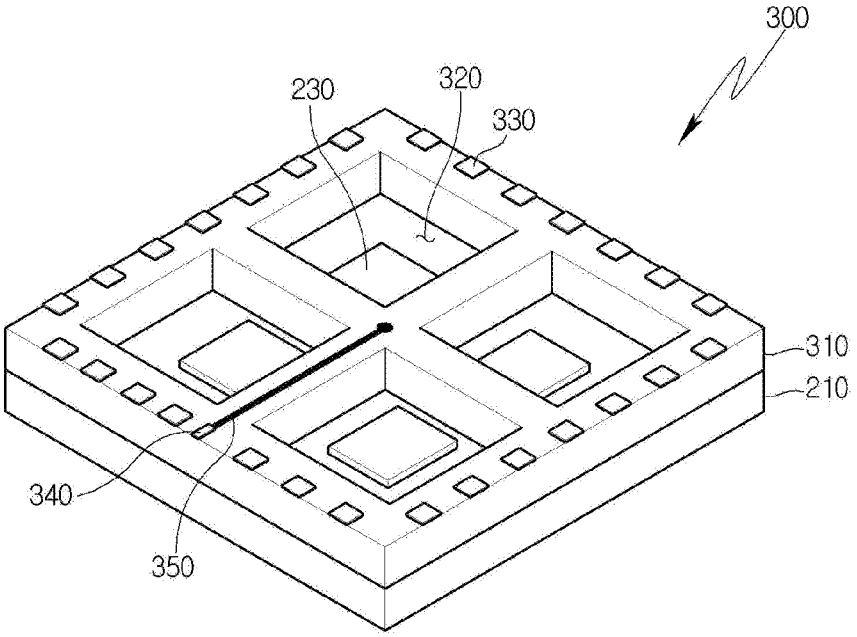

[FIG. 13]
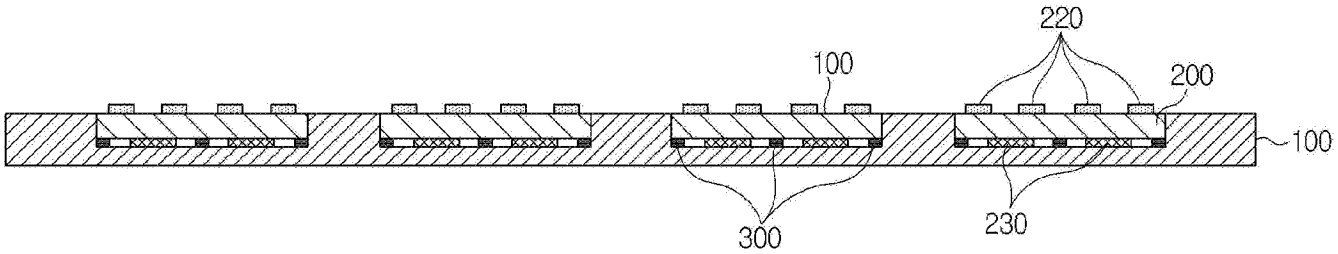

ANTENNA PACKAGE HAVING CAVITY STRUCTURE

TECHNICAL FIELD

The present disclosure relates to an antenna package having a cavity structure, and more particularly, to an antenna package having a cavity structure for 5G mobile communication.

BACKGROUND ART

The mobile communication industry provides various multimedia services to users through a 4G network. The 4G network has supported high-speed data transmission and network capacity using a frequency of about 2 GHz or less.

In the mobile communication industry, the network capacity has been increased 20 times or more through continuous technology development. During the same period, as the spread of smart devices rapidly increased, the demand for the network increased 100 times or more.

In the mobile communication industry, it is determined that the network capacity will soon reach a limit, and thus the research continues on the 5G network which improves the network capacity and the data transmission rate.

The 5G network transmits and receives data using an ultra-high frequency of about 28 GHz. The 5G network supports a faster data transmission rate and a larger network capacity than the existing 4G network.

As the mobile communication industry is switched to the 5G network, research on the antenna for supporting the 5G network is being conducted in the antenna industry.

DISCLOSURE

Technical Problem

The present disclosure is proposed in consideration of the above circumstances, and an object of the present disclosure is to provide an antenna package having a cavity structure, which disposes a cavity substrate on which an accommodation portion is formed in one surface of an antenna substrate formed with a signal processing element, thereby preventing the occurrence of deformation and breakage in a mounting process of an antenna package.

Technical Solution

For achieving the object, an antenna package having a cavity structure according to an exemplary embodiment of the present disclosure includes: an antenna substrate which has a plurality of radiation patches formed on the upper surface thereof, and a plurality of signal processing elements formed on the lower surface thereof and a cavity substrate which is formed with an accommodation portion receiving the plurality of signal processing elements, and disposed on the lower surface of the antenna substrate. The cavity substrate may have a rectangular frame shape in which one accommodation portion is formed, or a lattice shape in which a plurality of accommodation portions are formed.

Advantageous Effects

According to the present disclosure, the antenna package having the cavity structure may dispose the cavity substrate with the accommodation portion formed in one surface of the antenna substrate formed with the signal processing element, thereby preventing the occurrence of deformation and breakage in the mounting process of the antenna package.

Further, the antenna package having the cavity structure may dispose the cavity substrate with the accommodation portion formed in one surface of the antenna substrate formed with the signal processing element to prevent the occurrence of deformation and breakage, thereby minimizing deterioration of mass productivity and antenna performance of the antenna package.

Further, the antenna package having the cavity structure may configure the Wilkinson distributor and the T junction distributor, thereby minimizing dielectric loss.

DESCRIPTION OF DRAWINGS

FIGS. 1 and 2 are diagrams for explaining an antenna for a 5G network.

FIG. 3 is a diagram for explaining an antenna package having a cavity structure according to an exemplary embodiment of the present disclosure.

FIGS. 4 to 7 are diagrams for explaining an antenna substrate illustrated in FIG. 3.

FIGS. 8 to 12 are diagrams for explaining a cavity substrate illustrated in FIG. 3.

FIG. 13 is a diagram for explaining the antenna package having the cavity structure according to an exemplary embodiment of the present disclosure.

MODE FOR INVENTION

Hereinafter, the most preferred exemplary embodiments of the present disclosure will be described with reference to the accompanying drawings in order to specifically describe the exemplary embodiments so that those skilled in the art to which the present disclosure pertains may easily implement the technical spirit of the present disclosure. First, in adding reference numerals to the components of each drawing, it should be noted that the same components have the same reference numerals as much as possible even if they are displayed in different drawings. Further, in describing the present disclosure, when it is determined that the detailed description of the related well-known configuration or function may obscure the gist of the present disclosure, the detailed description thereof will be omitted.

Referring to FIGS. 1 and 2, an antenna for a 5G network (hereinafter, a 5G antenna) is installed on a base station. The 5G antenna supports communication using an ultra-high frequency by disposing a plurality of antenna packages 20 in a matrix.

The 5G antenna is configured by mounting the plurality of antenna packages 20 on a main substrate 10. The main substrate 10 is made of an organic or organic material such as LTCC and FR4. The main substrate 10 is formed with a plurality of receiving grooves 12 for receiving the antenna packages 20. The plurality of receiving grooves 12 are disposed in a matrix. The antenna package 20 is mounted to each of the plurality of receiving grooves 12. As an example, the 5G antenna is formed with 16 receiving grooves 12 disposed in 4 rows and 4 columns, and the antenna package 20 is mounted in each of the receiving grooves 12.

The 5G antenna is manufactured by disposing the antenna package 20 in the receiving groove 12 and then applying a predetermined pressure to seat the antenna package 20 in the receiving groove 12.

Since the antenna package 20 has a signal processing element mounted on a surface facing the bottom surface of the receiving groove 12, a separation space is formed between the bottom surface of the receiving groove 12 and the antenna package 20.

The 5G antenna has a problem in that a pressure is applied to the separation space in the process of inserting the antenna package 20 into the receiving groove 12 to cause deformation, breakage, the depression, distortion, or the like of the antenna package 20, thereby degrading mass productivity, or degrading antenna performance.

Accordingly, an exemplary embodiment of the present disclosure proposes an antenna package having a cavity structure (hereinafter referred to as a cavity antenna package) which prevents the occurrence of deformation and breakage in a process of inserting the antenna package into the receiving groove.

Referring to FIG. 3, a cavity antenna package 100 according to an exemplary embodiment of the present disclosure includes an antenna substrate 200 and a cavity substrate 300.

The antenna substrate 200 receives a 5G network frequency band signal (hereinafter, a 5G signal). The antenna substrate 200 includes a plurality of radiation patterns and signal processing elements 230. The antenna substrate 200 processes the 5G signal received through the radiation pattern in the signal processing element 230 and then transmits the processed 5G signal to the main substrate 10 of the antenna.

Referring to FIGS. 4 and 5, the antenna substrate 200 includes a ceramic substrate 210, a radiation patch 220, a signal processing element 230, and a first control signal transmission electrode 240. The antenna substrate 200 is inserted into the receiving groove 12 formed in the main substrate 10 of the 5G antenna. The lower surface of the antenna substrate 200 faces the bottom surface of the receiving groove 12.

The ceramic substrate 210 is a plate-shaped base substrate made of a ceramic material. The ceramic substrate 210 is a low temperature co-fired ceramic (LTCC) base substrate.

As an example, the ceramic substrate 210 is one of Zirconia Toughened Alumina (ZTA), aluminum nitride (AlN), aluminum oxide (alumina, Al2O3), and silicon nitride (SiN, Si3N4). The ceramic substrate 210 may also be a synthetic ceramic material including one or more of ZTA, aluminum nitride, aluminum oxide, and silicon nitride.

Further, the ceramic substrate 210 may be modified to be made of a ceramic material having low dielectric constant and dielectric loss for the substrate of the antenna.

The radiation patch 220 is formed on the upper surface of the ceramic substrate 210. The radiation patch 220 transmits and receives the 5G signal. As an example, the radiation patch 220 is a thin plate made of a conductive material having high electrical conductivity, such as copper, aluminum, gold, or silver.

A plurality of radiation patches 220 are configured and are disposed in a matrix on the upper surface of the ceramic substrate 210. As an example, the radiation patch 220 includes a first radiation patch to a sixteenth radiation patch.

A first radiation patch to a fourth radiation patch form a first row, a fifth radiation patch to an eighth radiation patch form a second row, and a ninth radiation patch to a twelfth radiation patch form a third row, and a thirteenth radiation patch to a sixteenth radiation patch form a fourth row.

The first radiation patch, the fifth radiation patch, the ninth radiation patch 220 and the thirteenth radiation patch form a first column, the second radiation patch, the sixth radiation patch, the tenth radiation patch 220, and the fourteenth radiation patch form a second column, the third radiation patch, the seventh radiation patch, the eleventh radiation patch 220, and the fifteenth radiation patch form a third column, the fourth radiation patch, the eighth radiation patch, the twelfth radiation patch 220, and the sixteenth radiation patch form a fourth column. Accordingly, the first to sixteenth radiation patches form a matrix of 4×4 arrangement on the upper surface of the ceramic substrate 210.

The signal processing element 230 is formed on the lower surface of the ceramic substrate 210. A plurality of signal processing elements 230 are configured and are disposed in a matrix on the lower surface of the ceramic substrate 210. The signal processing element 230 signal-processes the 5G signal received from the plurality of radiation patches 220. The signal processing element 230 transmits the 5G signal through the radiation patch 220.

As an example, the signal processing element 230 includes a first signal processing element to a fourth signal processing element. The first signal processing element is disposed close to a first side surface and a second side surface of the ceramic substrate 210, the second signal processing element is disposed close to the second side surface and a third side surface thereof, the third signal processing element is disposed close to the first side surface and the fourth side surface of the ceramic substrate 210, and the fourth signal processing element is disposed close to the third side surface and the fourth side surface thereof. Accordingly, the first signal processing element to the fourth signal processing element form a matrix of 2×2 arrangement.

The signal processing element 230 is connected to the plurality of radiation patches 220. The signal processing element 230 feeds the plurality of radiation patches 220 through a feed line (not illustrated) formed inside the ceramic substrate 210.

As an example, the first signal processing element is connected to the first radiation pattern, the second radiation pattern, the fifth radiation pattern, and the sixth radiation pattern. The second signal processing element is connected to the third radiation pattern, the fourth radiation pattern, the seventh radiation pattern, and the eighth radiation pattern. The third signal processing element is connected to the ninth radiation pattern, the tenth radiation pattern, the thirteenth radiation pattern, and the fourteenth radiation pattern. The fourth signal processing element is connected to the eleventh radiation pattern, the twelfth radiation pattern, the fifteenth radiation pattern, and the sixteenth radiation pattern. Accordingly, the signal processing element 230 is connected to four radiation patterns.

The signal processing element 230 may be connected to a feeding pattern (not illustrated) formed inside the ceramic substrate 210. The feeding pattern is connected to the signal processing element 230 through a feeding line. The signal processing element 230 supplies a signal for wireless signal transmission in the feeding pattern. The feeding pattern may feed the radiation patch 220 through coupling. Here, the coupling means that the feeding pattern and the radiation pattern are not directly in contact with each other but are electrically connected in a separated state.

The first control signal transmission electrode 240 is formed on the lower surface of the ceramic substrate 210. A plurality of first control signal transmission electrodes 240 are configured and are disposed to be spaced apart from each other. The first control signal transmission electrode 240 is located between the outer circumstance of the ceramic signal processing element 230 and the outer circumstance of the ceramic substrate 210.

The first control signal transmission electrode 240 is connected to the signal processing element 230 through an electrode (not illustrated) formed inside the ceramic substrate 210. The plurality of first control signal transmission electrodes 240 are connected to one signal processing element 230. The first control signal transmission electrode 240 transmits the signal processing element control signal transmitted from the main substrate 10 of the 5G antenna to the signal processing element 230.

Referring to FIG. 6, the antenna substrate 200 may further include a first RF signal transmission pattern 250 and an RF signal distributor 260.

The first RF signal transmission pattern 250 is formed on the lower surface of or inside the ceramic substrate 210. One end of the first RF signal transmission pattern 250 is located on one side of the ceramic substrate 210. One end of the first RF signal transmission pattern 250 is connected to the RF signal transmission electrode 340 formed on the cavity substrate 300 through a via hole formed in the cavity substrate 300. The other end of the first RF signal transmission pattern 250 is connected to the input terminal of the RF signal distributor 260.

The RF signal distributor 260 is composed of a distributor having one input terminal and a plurality of output terminals. The input terminal is connected to the first RF signal transmission pattern 250. The plurality of output terminals are connected to have one-to-one correspondence with the plurality of signal processing elements 230.

The RF signal distributor 260 is formed at the center of the lower surface of the ceramic substrate 210. As an example, the RF signal distributor 260 is disposed in a separation space between the first signal processing element to the fourth signal processing element.

The RF signal distributor 260 may also be formed inside the ceramic substrate 210. At this time, the plurality of output terminals are connected to the signal processing element 230 through the via hole.

The RF signal distributor 260 branches the 5G signal to transmit the branched 5G signal to the first signal processing element to the fourth signal processing element. The RF signal distributor 260 transmits to the main substrate 10 the 5G frequency band signal (that is, the signal received from the radiation patch 220) signal-processed by the first signal processing element to the fourth signal processing element.

As an example, the RF signal distributor 260 is a 4-Way Wilkinson distributor. The 4-Way Wilkinson distributor is composed of four output terminals. The first to fourth signal processing elements are each connected to the four output terminals.

Referring to FIG. 7, the antenna substrate 200 may further include a first RF signal distributor 262, a second RF signal distributor 264, and a first RF signal transmission pattern 250.

The first RF signal distributor 262 and the second RF signal distributor 264 are formed on the lower surface of or inside the ceramic substrate 210. The first RF signal distributor 262 is disposed in a separation space between the first signal processing element and the third signal processing element.

The first RF signal distributor 262 is composed of a distributor having one input terminal and a pair of output terminals. The input terminal is connected to one end of the first RF signal transmission pattern 250. The pair of output terminals are each connected to have one-to-one correspondence with the signal processing element 230.

As an example, the first RF signal distributor 262 is a 2-Way Wilkinson distributor having two output terminals. The input terminal of the 2-Way Wilkinson distributor is connected to one end of the first RF signal transmission pattern 250. The first output terminal of the 2-Way Wilkinson distributor is connected to the first signal processing element, and the second output terminal is connected to the third signal processing element.

The second RF signal distributor 264 and the second RF signal distributor 264 are formed on the lower surface of or inside the ceramic substrate 210. The second RF signal distributor 264 is disposed in a separation space between the second signal processing element and the fourth signal processing element.

The second RF signal distributor 264 is composed of a distributor having one input terminal and a pair of output terminals. The input terminal is connected to the other end of the first RF signal transmission pattern 250. The pair of output terminals are each connected to have one-to-one correspondence with the signal processing element 230.

As an example, the second RF signal distributor 264 is a 2-Way Wilkinson distributor having two output terminals. The input terminal of the 2-Way Wilkinson distributor is connected to the other end of the first RF signal transmission pattern 250. The first output terminal of the 2-Way Wilkinson distributor is connected to the second signal processing element, and the second output terminal thereof is connected to the fourth signal processing element.

The first RF signal transmission pattern 250 is formed on the lower surface of or inside the ceramic substrate 210. One end of the first RF signal transmission pattern 250 is connected to the input terminal of the first RF signal distributor 262. The other end of the first RF signal transmission pattern 250 is connected to the input terminal of the second RF signal distributor 264. The first RF signal transmission pattern 250 is connected to the second RF signal transmission pattern 350 formed on the cavity substrate 300 through a via hole formed in the cavity substrate 300.

The antenna package 100 having the cavity structure according to an exemplary embodiment of the present disclosure may branch the RF signal using the 2-Way Wilkinson distributor, thereby minimizing dielectric loss.

The cavity substrate 300 is located on the lower surface of the antenna substrate 200. The cavity substrate 300 is a reinforcing member for preventing deformation and breakage due to pressure applied when the cavity antenna package 100 is inserted into and mounted in the receiving groove 12 of the main substrate 10.

The cavity substrate 300 is integrally formed with the antenna substrate 200. The cavity substrate 300 is made of the same ceramic material as the antenna substrate 200, and is simultaneously formed with the antenna substrate 200 through the LTCC process.

The cavity substrate 300 may be manufactured while being separated from the antenna substrate 200 and then bonded to the lower surface of the antenna substrate 200. The cavity substrate 300 may be made of the same ceramic material as the antenna substrate 200. The cavity substrate 300 may be made of a material different from that of the antenna substrate 200 (for example, FR4 or the like) to reduce manufacturing cost and improve mass productivity.

The thickness of the cavity substrate 300 is preferably the thickness or more of the signal processing element 230 exposed to the lower surface of the antenna substrate 200. This is to prevent deformation and breakage of the cavity antenna package 100 by preventing the occurrence of the separation space when the cavity antenna package 100 is inserted into the main substrate 10.

Referring to FIGS. 8 and 9, the cavity substrate 300 includes a cavity frame 310.

The cavity frame 310 has a rectangular plate-shaped frame. The cavity frame 310 is formed with an accommodation portion 320 which accommodates the signal processing element 230 formed on the lower surface of the antenna substrate 200. The accommodation portion 320 is formed in a rectangular hole shape with the upper and lower ends open to accommodate all of the signal processing elements 230 formed on the lower surface of the antenna substrate 200. Accordingly, the cavity frame 310 is formed in a square frame shape.

A second control signal transmission electrode 330 is formed on the lower surface of the cavity frame 310. The second control signal transmission electrode 330 is disposed close to the outer circumstance of the cavity frame 310. A plurality of second control signal transmission electrodes 330 are configured and are formed to be spaced apart from each other on the lower surface of the cavity frame 310. The second control signal transmission electrode 330 is connected to have one-to-one correspondence with the first control signal transmission electrode 240 formed on the antenna substrate 200 through a via hole penetrating the cavity frame 310.

The RF signal transmission electrode 340 is formed on the lower surface of the cavity frame 310. The RF signal transmission electrode 340 is formed to be spaced apart from the second control signal transmission electrode 330. The RF signal transmission electrode 340 is connected to the first RF signal transmission pattern 250 (see FIG. 6) of the antenna substrate 200 through the via hole. Accordingly, the cavity antenna package 100 forms a 4-Way Wilkinson distributor.

Referring to FIG. 10, a plurality of accommodation portions 320 may be formed in the cavity frame 310.

The plurality of accommodation portions 320 each accommodates one signal processing element 230. As an example, the cavity substrate 300 includes the cavity frame 310 having a lattice structure in which a first accommodation portion to a fourth accommodation portion are formed. The plurality of accommodation portions 320 are formed in a square hole shape with the upper and lower ends open. Accordingly, the cavity frame 310 is formed in a lattice structure.

As an example, the cavity frame 310 forms a configuration in which four accommodation portions 320 (that is, the first accommodation portion to the fourth accommodation portion) are disposed in a lattice shape by combining a transverse diaphragm and a longitudinal diaphragm. The cavity frame 310 is connected in a direction in which the transverse diaphragm and the longitudinal diaphragm are perpendicular to each other to form a square frame shape as a whole, and at the same time, each of the accommodation portions 320 is formed in a rectangular hole shape. The first signal processing element is accommodated in the first accommodation portion, the second signal processing element is accommodated in the second accommodation portion, the third signal processing element is accommodated in the third accommodation portion, and the fourth signal processing element is accommodated in the fourth accommodation portion.

As described above, the cavity substrate 300 may be formed with the plurality of accommodation portions 320 to form the cavity frame 310 having the lattice structure, thereby increasing the reinforcing strength of the antenna package.

Referring to FIGS. 11 and 12, a second RF signal transmission pattern 350 may be formed on the lower surface of the cavity frame 310. One end of the second RF signal transmission pattern 350 is connected to the RF signal transmission electrode 340. The other end of the second RF signal transmission pattern 350 is formed to extend toward the center of the cavity frame 310 and is connected to the first RF signal transmission pattern 250 (see FIG. 7) of the antenna substrate 200 through a via hole.

Accordingly, the first RF signal transmission pattern 250 and the second RF signal transmission pattern 350 form a T junction distributor.

The cavity antenna package 100 may form the 2-Way Wilkinson distributor and the T junction distributor to distribute signals, thereby minimizing dielectric loss compared to the structure in which the 4-Way Wilkinson distributor is formed.

Referring to FIG. 13, the cavity antenna package 100 may form the cavity substrate 300 on the antenna substrate 200, thereby preventing deformation and breakage of the antenna package in a process in which the cavity substrate 300 supports the separation space between the antenna substrate 200 and the bottom surface of the receiving groove 12 to insert the antenna package into the receiving groove 12 of the main substrate 10.

Although the preferred exemplary embodiment of the present disclosure has been described above, it is understood that the present disclosure may be modified in various forms, and those skilled in the art may carry out various modified examples and changed examples without departing from the scope of the claims of the present disclosure.

The invention claimed is:

1. An antenna package having a cavity structure comprising:

an antenna substrate having a plurality of radiation patches formed on an upper surface thereof, and a plurality of signal processing elements formed on a lower surface thereof; and a cavity substrate formed with a plurality of accommodation portions accommodating each of the plurality of signal processing elements, and disposed on the lower surface of the antenna substrate, wherein the antenna substrate comprises:

a plate-shaped ceramic substrate;

a first RF signal transmission pattern which is formed on the ceramic substrate;

a first RF signal distributor which is formed on the ceramic substrate, and has an input terminal connected to one end of the first RF signal transmission pattern and a plurality of output terminals connected to some of the plurality of signal processing elements, and a second RF signal distributor which is formed on the ceramic substrate to be spaced apart from the first RF signal distributor, and has an input terminal connected to the other end of the first RF signal transmission pattern and a plurality of output terminals connected to the plurality of signal processing elements other than some of the plurality of signal processing elements, wherein the cavity substrate comprises:

a cavity frame in which the plurality of accommodation portions formed; and a second RF signal transmission pattern which is formed on a lower surface of the cavity frame, and wherein one end of the second RF signal transmission pattern is connected to an RF signal transmission electrode, and the other end of the second RF signal transmission pattern is formed to extend toward the center of the cavity frame and is connected to the first RF signal transmission pattern of the antenna substrate through a via hole.

2. The antenna package having the cavity structure of claim 1, wherein the antenna substrate further comprises a plurality of first control signal transmission electrodes formed on the lower surface of the ceramic substrate, and disposed to be spaced apart from each other along the outer circumference of the ceramic substrate, and wherein the plurality of radiation patches are disposed in a matrix on the upper surface of the ceramic substrate, and wherein the plurality of signal processing elements are disposed in a matrix on the lower surface of the ceramic substrate.

3. The antenna package having the cavity structure of claim 1, wherein the first RF signal distributor and the second RF signal distributor are 2-Way Wilkinson distributors.

4. The antenna package having the cavity structure of claim 1, wherein the cavity substrate further comprises: a second control signal transmission electrode which is formed on the lower surface of the cavity frame, and connected to the first control signal transmission electrode formed on the antenna substrate.

5. The antenna package having the cavity structure of claim 4, wherein the RF signal transmission electrode is formed on the lower surface of the cavity frame to be spaced apart from the second control signal transmission electrode.

6. The antenna package having the cavity structure of claim 1, wherein the cavity frame has a lattice shape in which the plurality of accommodation portions are disposed in a matrix.

7. The antenna package having the cavity structure of claim 1, wherein the cavity substrate is made of the same ceramic material as the antenna substrate.

8. The antenna package having the cavity structure of claim 1, wherein the cavity substrate is made of a material different from that of the antenna substrate.

* * * * *